US012638268B2

(12) United States Patent
Dent

(10) Patent No.: US 12,638,268 B2
(45) Date of Patent: May 26, 2026

(54) EXTENDABLE BLADE FIREARM ATTACHMENT DEVICE

(71) Applicant: Andrew Dent, Cape Coral, FL (US)

(72) Inventor: Andrew Dent, Cape Coral, FL (US)

( * ) Notice: Subject to any disclaimer, the term of this patent is extended or adjusted under 35 U.S.C. 154(b) by 0 days.

(21) Appl. No.: 19/225,148

(22) Filed: Jun. 2, 2025

(65) Prior Publication Data

US 2026/0104231 A1 Apr. 16, 2026

Related U.S. Application Data

(63) Continuation-in-part of application No. 18/598,783, filed on Mar. 7, 2024, now Pat. No. 12,410,988.

(51) Int. Cl.
*F41C 23/16* (2006.01)
*F41C 27/16* (2006.01)

(52) U.S. Cl.
CPC ..... *F41C 23/16* (2013.01); *F41C 27/16* (2013.01)

(58) Field of Classification Search
CPC ..... F41C 23/16; F41C 23/12; F41C 27/16
USPC ..... 42/94, 72
See application file for complete search history.

(56) References Cited

U.S. PATENT DOCUMENTS

| | | | | |
|---|---|---|---|---|
| 5,064,988 | A | 11/1991 | Enama | |
| 5,345,706 | A | 9/1994 | Brown | |
| 7,676,975 | B2 | 3/2010 | Phillips | |
| 7,866,083 | B2 | 1/2011 | Teetzel | |
| 7,987,623 | B1 * | 8/2011 | Moody | F41G 11/003 42/71.01 |
| 8,117,782 | B2 | 2/2012 | Gross | |
| 8,607,492 | B2 | 12/2013 | Hartley | |
| 8,627,591 | B2 | 1/2014 | Moore | |
| 9,062,933 | B1 | 6/2015 | Allen | |
| 9,234,722 | B2 | 1/2016 | Rice | |
| D876,572 | S | 2/2020 | Ding | |
| 10,845,157 | B2 | 11/2020 | Chavez | |
| 10,942,004 | B2 | 3/2021 | Grenier | |
| 10,982,927 | B2 | 4/2021 | Bonesteel | |
| 11,112,208 | B1 * | 9/2021 | Mantas | F41C 23/16 |
| 11,499,797 | B2 | 11/2022 | Mantas | |
| 2009/0193702 | A1 | 8/2009 | Lin | |
| 2014/0338245 | A1 | 11/2014 | Lanasa | |

FOREIGN PATENT DOCUMENTS

| | | | | |
|---|---|---|---|---|
| GB | 2456545 A | * | 7/2009 | F41C 33/08 |
| GB | 2470964 | | 12/2010 | |
| KR | 102085462 | | 3/2020 | |

* cited by examiner

*Primary Examiner* — Reginald S Tillman, Jr.

(57) ABSTRACT

An extendable blade firearm attachment device includes a handguard configured to mount to a barrel of a firearm. An elongated monopod is coupled to the handguard. The monopod has a main body and a connection to the handguard such that the monopod is movable between an extended position and a retracted position. The monopod extends away from the handguard from a proximal end to a distal end when in the extended position. A monopod fastener removably couples the monopod to the handguard. A knife blade is pivotably coupled to the monopod to be pivotable between a closed position and an open position. A spine of the knife blade is exposed relative to the monopod when the knife blade is in the closed position.

12 Claims, 8 Drawing Sheets

EXTENDABLE BLADE FIREARM ATTACHMENT DEVICE

CROSS-REFERENCE TO RELATED APPLICATIONS

This application is a continuation in part of application Ser. No. 18/598,783 filed on Mar. 7, 2024.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to firearm attachment devices and more particularly pertains to a new firearm attachment device for providing a monopod having a main body removably attached to a firearm and a knife blade having an exposed spine to facilitate pivotably extending the knife blade from the main body of the monopod.

(2) Description of Related Art Including Information Disclosed Under 37 CFR 1.97 and 1.98

The prior art relates to firearm attachment devices. Known firearm attachment devices provide for detachable monopods which have fully enclosed blades requiring overly complex deployment mechanisms.

BRIEF SUMMARY OF THE INVENTION

An embodiment of the disclosure meets the needs presented above by generally comprising a handguard configured to mount to a barrel of a firearm. An elongated monopod is coupled to the handguard. The monopod has a main body and a connection to the handguard such that the monopod is movable between an extended position and a retracted position. The monopod extends away from the handguard from a proximal end to a distal end when in the extended position. A monopod fastener removably couples the monopod to the handguard. A knife blade is pivotably coupled to the monopod to be pivotable between a closed position and an open position. A spine of the knife blade is exposed relative to the monopod when the knife blade is in the closed position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
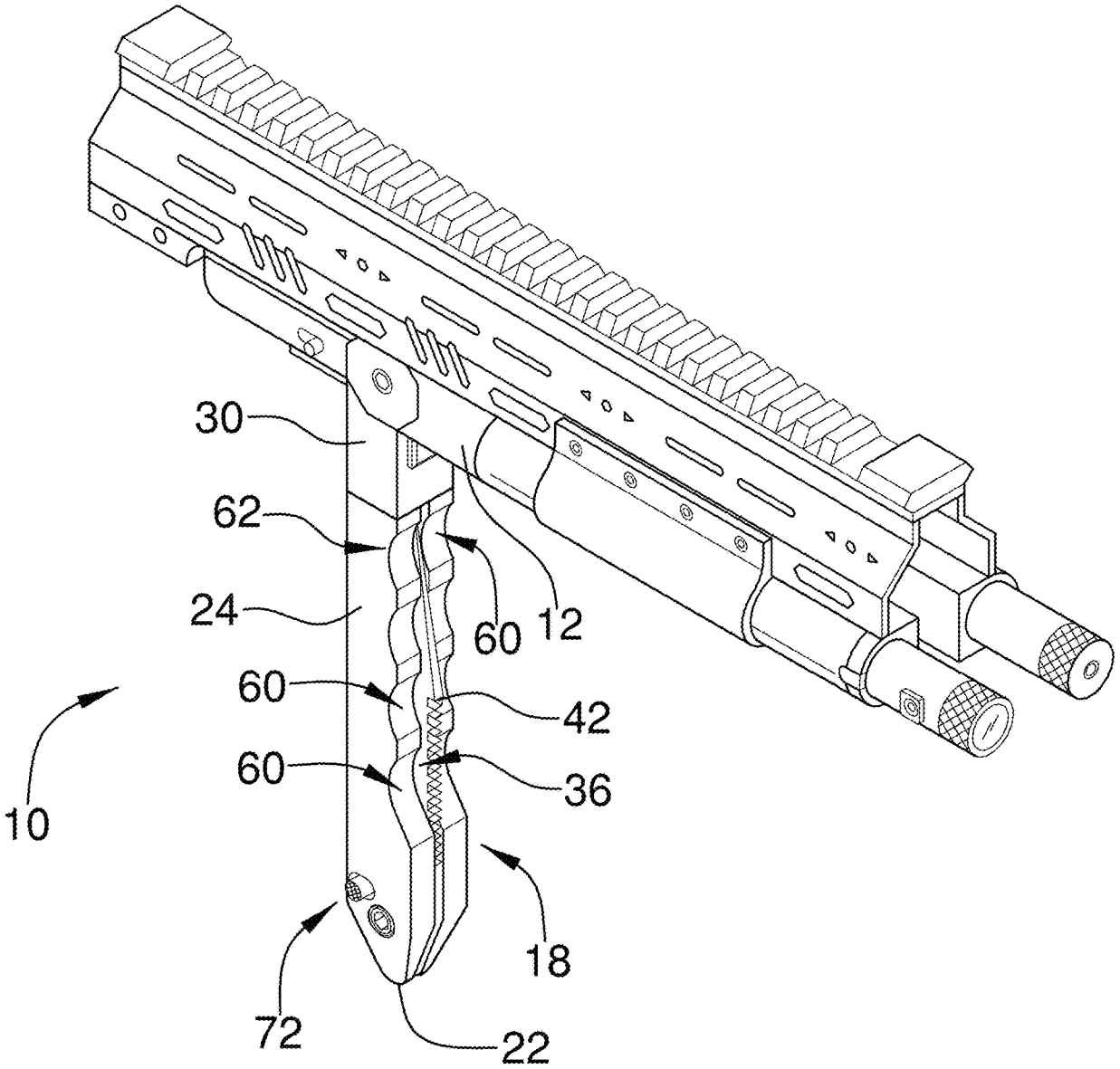
FIG. 1 is a top front side perspective view of a knife monopod firearm attachment according to an embodiment of the disclosure.
Figure 2:
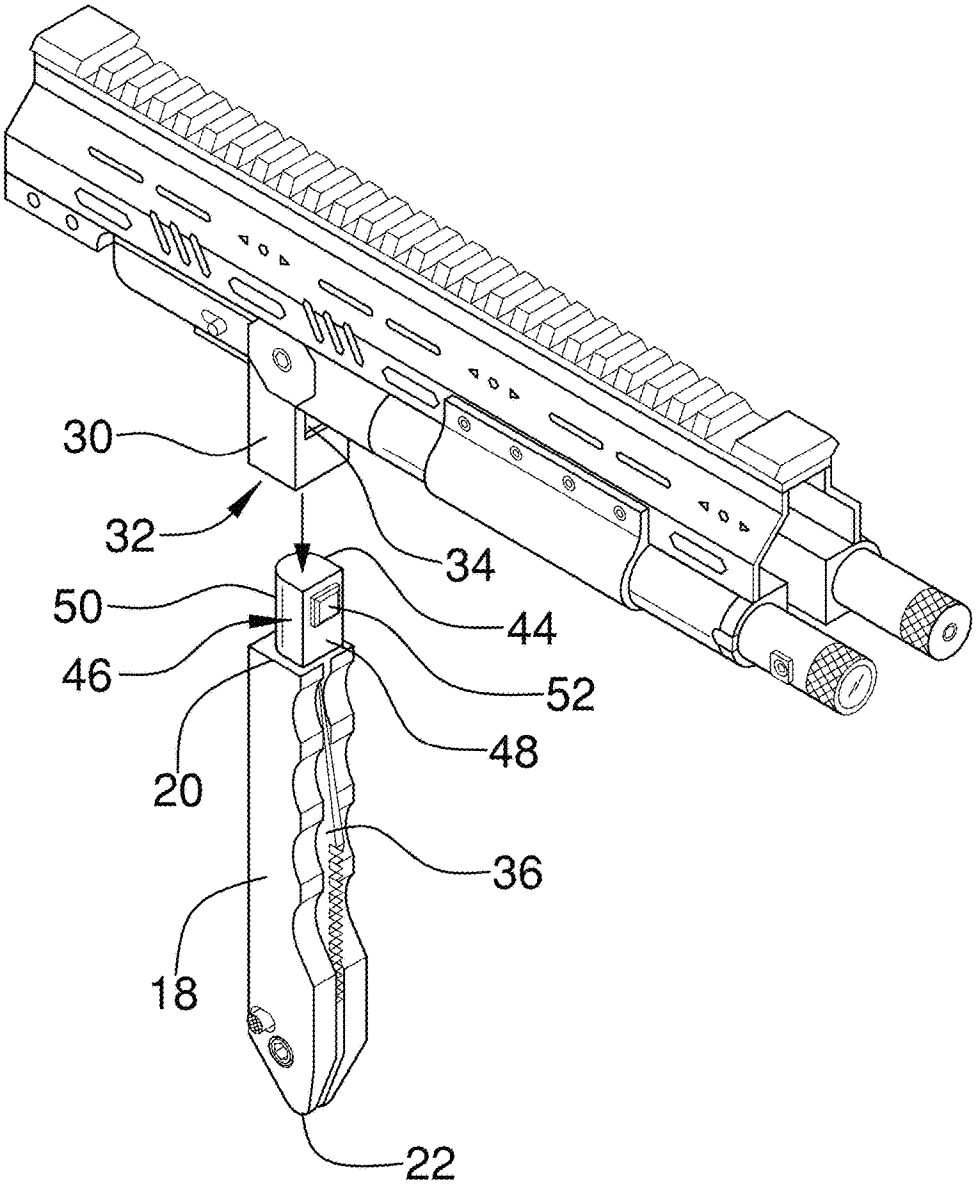
FIG. 2 is a partially exploded top front side perspective view of an embodiment of the disclosure.
Figure 3:
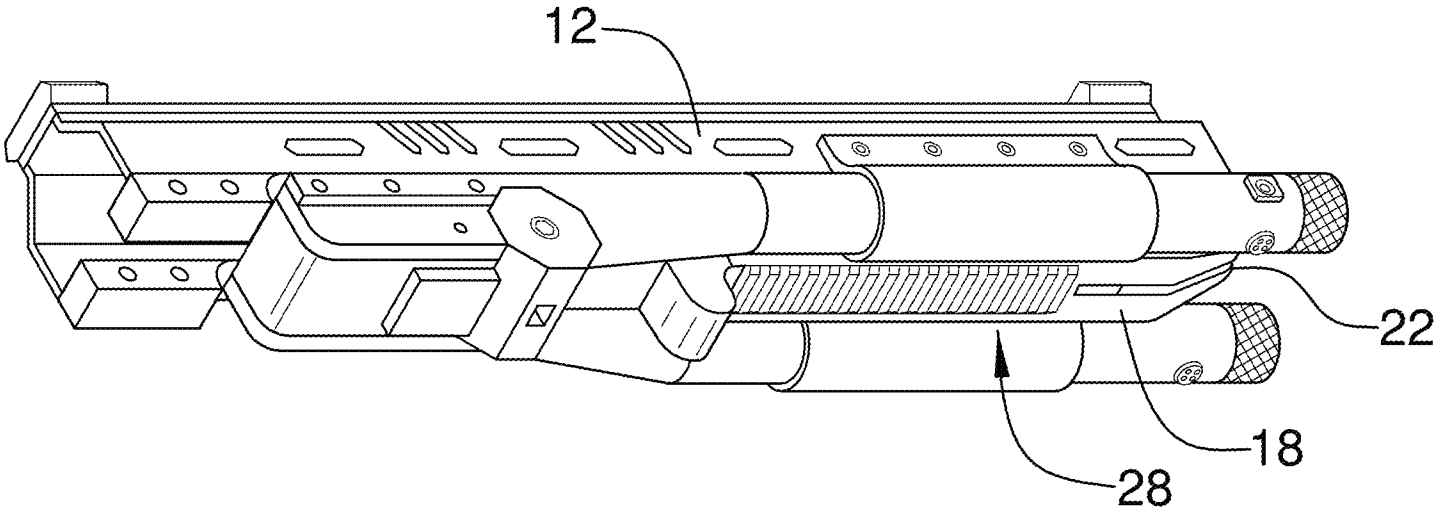
FIG. 3 is a bottom rear side perspective view of an embodiment of the disclosure.
Figure 4:
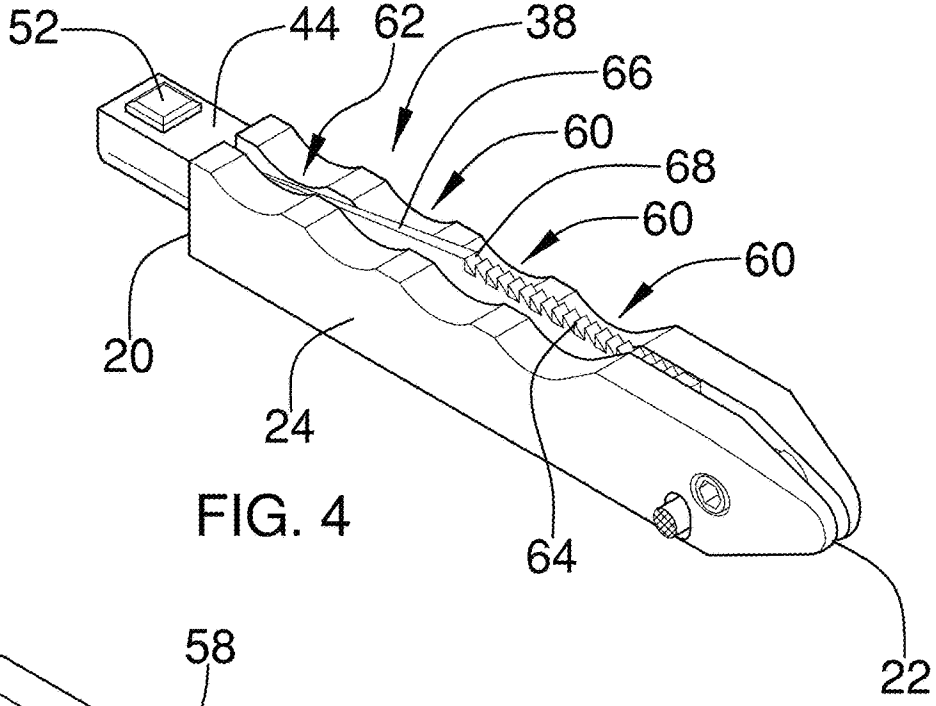
FIG. 4 is a perspective view of a monopod of an embodiment of the disclosure in a closed position.
Figure 5:
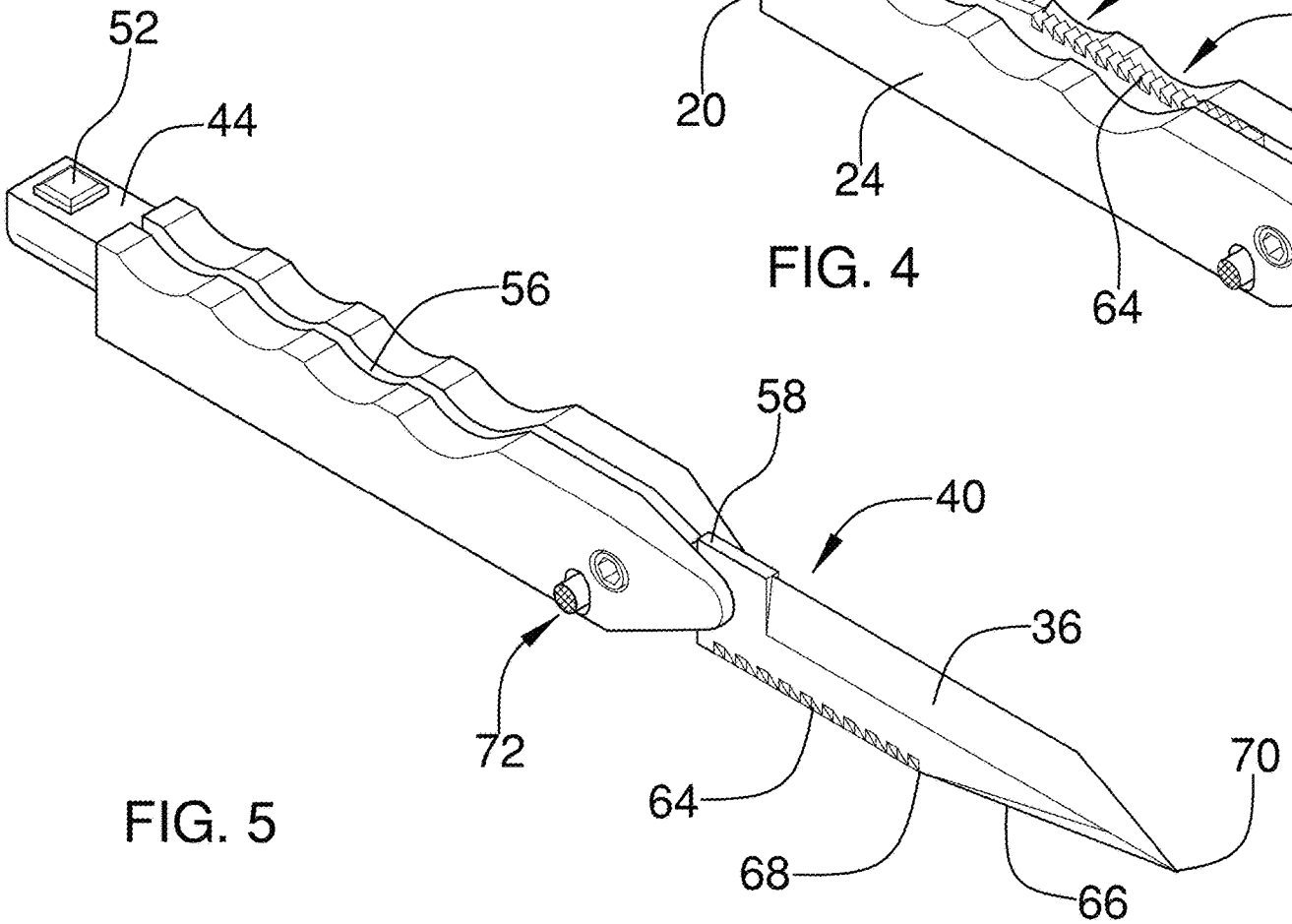
FIG. 5 is a perspective view of a monopod of an embodiment of the disclosure in an open position.
Figure 6:
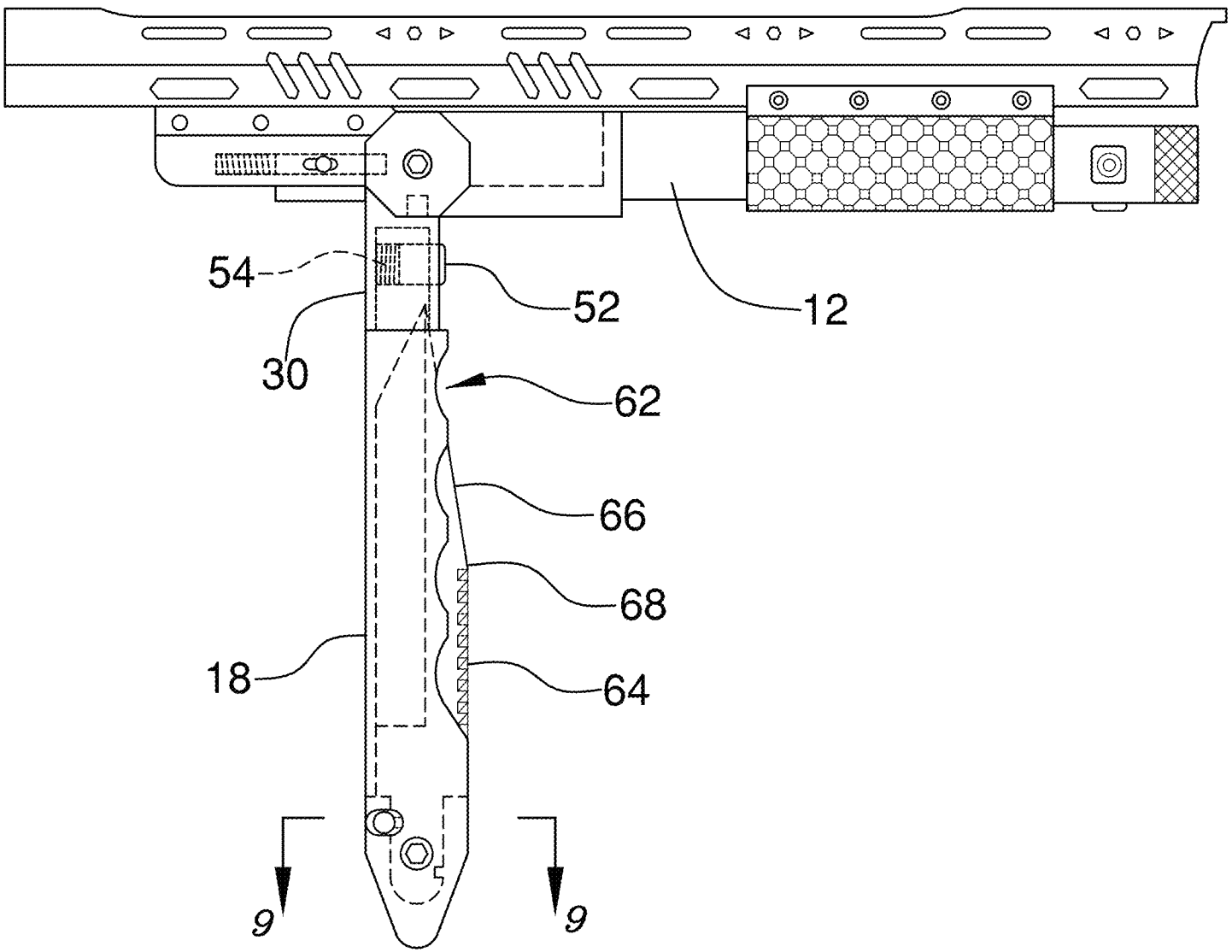
FIG. 6 is a side view of an embodiment of the disclosure.
Figure 7:
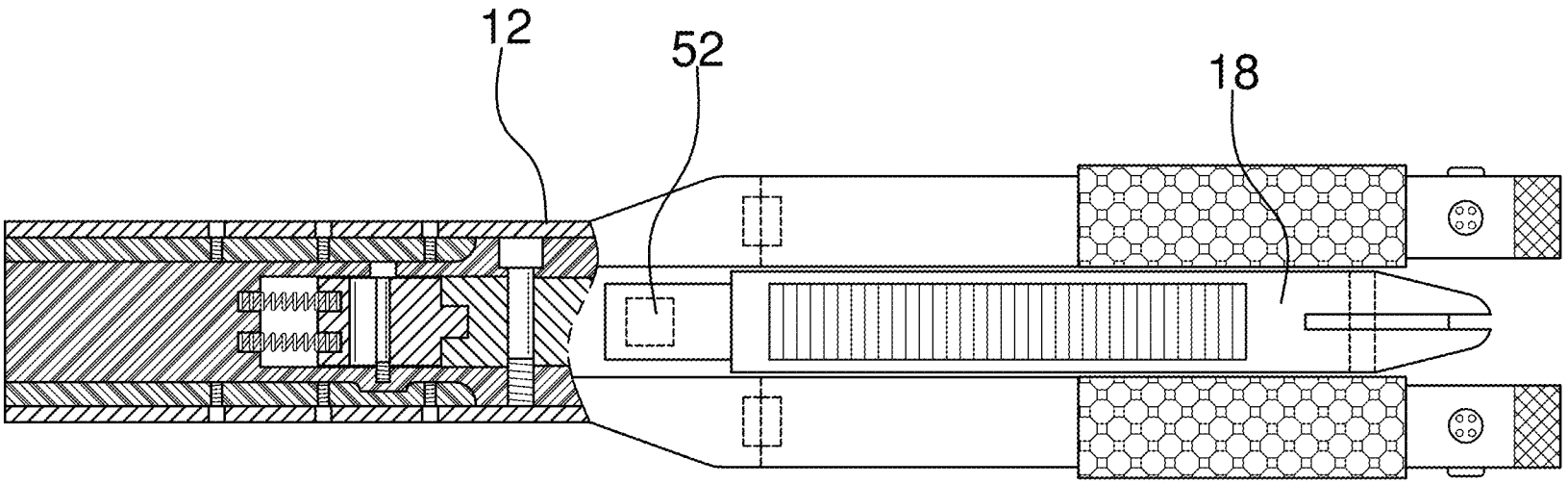
FIG. 7 is a partial cut-away bottom view of an embodiment of the disclosure.
Figure 8:
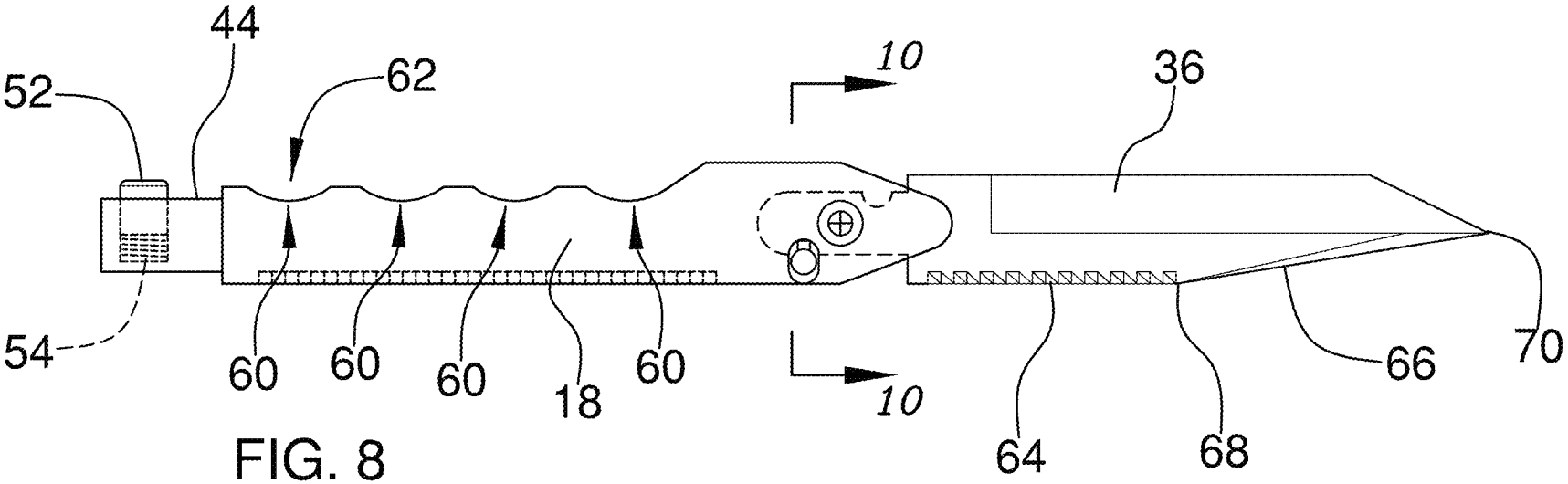
FIG. 8 is a side view of a monopod of an embodiment of the disclosure.
Figure 10:
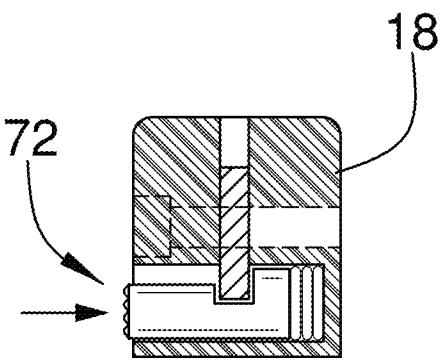
FIG. 10 is a cross-sectional view of an embodiment of the disclosure taken along line 10-10 of FIG. 8.
Figure 9:
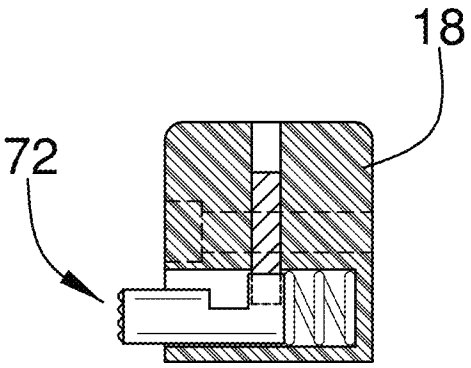
FIG. 9 is a cross-sectional view of an embodiment of the disclosure taken along line 9-9 of FIG. 6.
Figure 11:
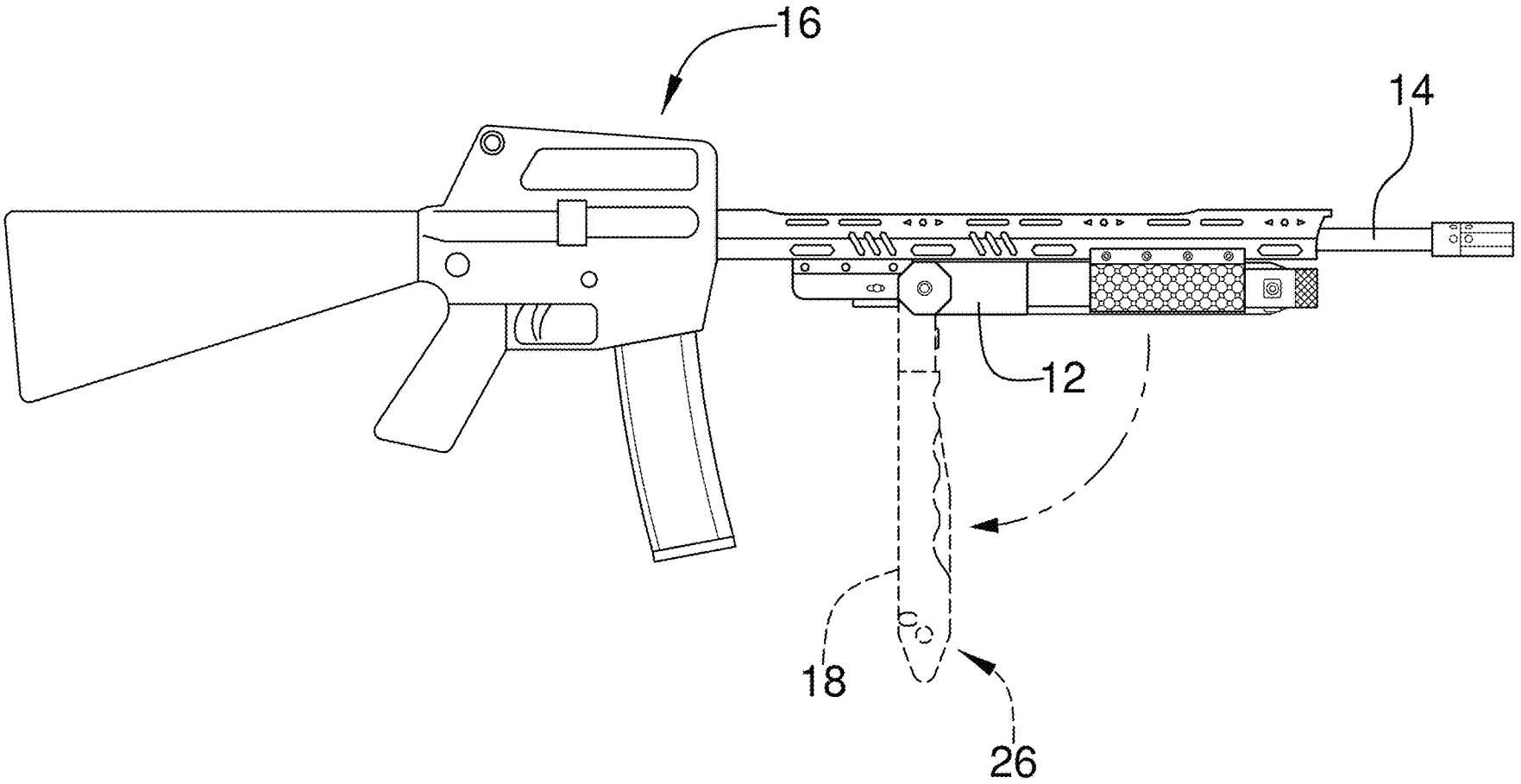
FIG. 11 is a side view of an embodiment of the disclosure.

With reference now to the drawings, and in particular to FIGS. 1 through 11 thereof, a new firearm attachment device embodying the principles and concepts of an embodiment of the disclosure and generally designated by the reference numeral 10 will be described.

As best illustrated in FIGS. 1 through 11, the knife monopod firearm attachment 10 generally comprises a handguard 12 configured to mount to a barrel 14 of a firearm 16. A monopod 18 is coupled to a bottom side of the handguard 12 by way of a picatinny rail or the like. The monopod 18 is elongated between a proximal end 20 relative to the handguard 12 and a distal end 22 relative to the handguard 12. The monopod 18 has a main body 24 and a connection to said handguard 12 such that said monopod is movable between an extended position 26 and a retracted position 28. The monopod 18 extends away from the handguard 12 from the proximal end 20 to the distal end 22 when in the extended position 26. A monopod fastener 30 removably couples the monopod 18 to the handguard 12. The monopod fastener 30 is pivotable relative to the handguard 12 for extending and retracting the monopod 18 between the extended position 26 and the retracted position 28. The monopod fastener 30 has a channel 32 and an aperture 34 extending through the monopod fastener 30. The aperture 34 is aligned with the channel 32. A knife blade 36 is pivotably coupled to the monopod 18. The knife blade 36 is pivotable between a closed position 38 and an open position 40. A spine 42 of the knife blade 36 is exposed relative to the monopod 18 when the knife blade 36 is in the closed position 38.

A knob 44 extends from the main body 24 of the monopod 18. The knob 44 has a peripheral shape complementary to the channel 32 such that the knob 44 is insertable into the channel 32. The knob 44 has an irregular peripheral shape 46 wherein the knob 44 inhibits twisting of the main body 24 of the monopod 18 relative to the monopod fastener 30. The irregular peripheral shape 46 of the knob 44 includes a planar face 48 positioned opposite to an arcuate face 50. A button 52 is positioned on the knob 44. The button 52 is complementary in shape and extends into the aperture 34 wherein the button 52 secures the monopod 18 to the monopod fastener 30. The button 52 is positioned on the planar face 48 of the irregular peripheral shape 46 of the knob 44. The button 52 is biased outwardly by a spring 54.

A knife slot 56 extends into the main body 24 of the monopod 18. The knife blade 36 has a base end 58 pivotably coupled to the main body 24 of the monopod 18 within the knife slot 56. The main body 24 of the monopod 18 has a plurality of arcuate indentations 60 extending along the knife slot 56. The knife blade 36 extends out of the knife slot 56 such that a portion of the spine 42 of the knife blade 36 is outwardly offset from all but a nearest one 62 of the indentations 60 relative to the handguard 12. The spine 42 of the knife blade 36 has a proximal extent 64 and a distal extent 66 relative to the base end 58 of the knife blade 36. The distal extent 66 is angled relative to the proximal extent 64 such that the knife blade 36 tapers extending from a junction 68 of the proximal extent 64 and the distal extent 66 towards a tip 70 of the knife blade 36. A blade lock 72 is coupled to the main body 24 of the monopod 18. The blade lock 72 is biased to be engageable to the knife blade 36 to secure the knife blade 36 in the open position 40.

In use, the monopod 18 is attached to the handguard 12 and is then pivotable as needed for use to steady the firearm 16 if desired. The monopod 18 further provides an additional grip for holding the firearm 16. The monopod 18 is disengaged from the handguard 12 when desired by operation of the button 52. The knife blade 36 can then be grasped by the spine 42 to pivot the knife blade 36 to the open position 40.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A firearm attachment comprising:

a handguard configured to mount to a barrel of a firearm;

a monopod coupled to a bottom side of said handguard, said monopod being elongated between a proximal end of the monopod relative to said handguard and a distal end of the monopod relative to said handguard, said monopod having a main body and a connection to said handguard such that said monopod is movable between an extended position and a retracted position, said monopod extending away from said handguard from said proximal end to said distal end when in said extended position;

a monopod fastener removably coupling said monopod to said handguard; and a knife blade pivotably coupled to said monopod, said knife blade being pivotable between a closed position and an open position, a spine of said knife blade being exposed relative to said monopod when said knife blade is in said closed position.

2. The firearm attachment device of claim 1, wherein said monopod fastener is pivotable relative to said handguard for extending and retracting said monopod between said extended position and said retracted position.

3. The firearm attachment device of claim 1, further comprising:

said monopod fastener having a channel and an aperture extending through said monopod fastener, said aperture being aligned with said channel;

a knob extending from said main body of said monopod, said knob having a peripheral shape complementary to said channel such that said knob is insertable into said channel; and a button positioned on said knob, said button being complementary in shape and extended into said aperture wherein said button secures said monopod to said monopod fastener.

4. The firearm attachment device of claim 3, further comprising said knob having an irregular peripheral shape wherein said knob inhibits twisting of said main body of said monopod relative to said fastener.

5. The firearm attachment device of claim 4, further comprising said irregular peripheral shape of said knob including a planar face positioned opposite to an arcuate face.

6. The firearm attachment device of claim 5, further comprising said button being positioned on said planar face of said irregular shape of said knob.

7. The firearm attachment device of claim 1, further comprising a knife slot extending into said main body of said monopod, said knife blade having a base end pivotably coupled to said main body of said monopod within said knife slot.

8. The firearm attachment device of claim 7, further comprising said main body of said monopod having a plurality of arcuate indentations extending along said knife slot.

9. The firearm attachment device of claim 8, further comprising said knife blade extending out of said knife slot such that a portion of said spine of said knife blade is outwardly offset from all but a nearest one of said indentations relative to said handguard.

10. The firearm attachment device of claim 8, further comprising said spine of said knife blade having a proximal extent and a distal extent relative to said base end of said knife blade, said distal extent being angled relative to said proximal extent such that said knife blade tapers extending from a junction of said proximal extent and said distal extent towards a tip of said knife blade.

11. The firearm attachment device of claim 1, further comprising a blade lock coupled to said main body of said monopod, said blade lock being engageable to said knife blade to secure said knife blade in said open position.

12. A firearm attachment comprising:

a handguard configured to mount to a barrel of a firearm;

a monopod coupled to a bottom side of said handguard, said monopod being elongated between a proximal end of the monopod relative to said handguard and a distal end of the monopod relative to said handguard, said monopod having a main body and a connection to said handguard such that said monopod is movable between an extended position and a retracted position, said monopod extending away from said handguard from said proximal end to said distal end when in said extended position;

a monopod fastener removably coupling said monopod to said handguard, wherein said monopod fastener is pivotable relative to said handguard for extending and retracting said monopod between said extended position and said retracted position, said monopod fastener having a channel and an aperture extending through said monopod fastener, said aperture being aligned with said channel;

a knife blade pivotably coupled to said monopod, said knife blade being pivotable between a closed position and an open position, a spine of said knife blade being exposed relative to said monopod when said knife blade is in said closed position;

a knob extending from said main body of said monopod, said knob having a peripheral shape complementary to said channel such that said knob is insertable into said channel, said knob having an irregular peripheral shape wherein said knob inhibits twisting of said main body of said monopod relative to said fastener, said irregular peripheral shape of said knob including a planar face positioned opposite to an arcuate face;

a button positioned on said knob, said button being complementary in shape and extended into said aperture wherein said button secures said monopod to said monopod fastener, said button being positioned on said planar face of said irregular shape of said knob;

a knife slot extending into said main body of said monopod, said knife blade having a base end pivotably coupled to said main body of said monopod within said knife slot;

said main body of said monopod having a plurality of arcuate indentations extending along said knife slot, said knife blade extending out of said knife slot such that a portion of said spine of said knife blade is outwardly offset from all but a nearest one of said indentations relative to said handguard;

said spine of said knife blade having a proximal extent and a distal extent relative to said base end of said knife blade, said distal extent being angled relative to said proximal extent such that said knife blade tapers extending from a junction of said proximal extent and said distal extent towards a tip of said knife blade; and a blade lock coupled to said main body of said monopod, said blade lock being engageable to said knife blade to secure said knife blade in said open position.

* * * * *